US005731141A

United States Patent [19]

Cogliolo et al.

[11] Patent Number: 5,731,141

[45] Date of Patent: Mar. 24, 1998

[54] LIGHT-SENSITIVE PHOTOGRAPHIC MATERIALS COMPRISING TABULAR SILVER HALIDE GRAINS AND AZODICARBONAMIDE DERIVATIVES

[75] Inventors: Isabella Cogliolo, Genoa; Ivano Delprato, Rocchetta Di Cairo; Luca Ceruti, Bergeggi; Stefano Mana, Fossano; Stefano Parodi, Savona, all of Italy

[73] Assignee: Imation Corp., Oakdale, Minn.

[21] Appl. No.: 651,068

[22] Filed: May 21, 1996

[30] Foreign Application Priority Data

Jun. 16, 1995 [EP] European Pat. Off. ..... 95109376

[51] Int. Cl.[6] ..... G03C 1/005

[52] U.S. Cl. ..... 430/567; 430/600; 430/607; 430/613

[58] Field of Search ..... 430/567, 600, 430/607, 613

[56] References Cited

U.S. PATENT DOCUMENTS

| | | | |
|---|---|---|---|
| 3,655,391 | 4/1972 | Merli et al. . | |
| 3,819,380 | 6/1974 | Baldassarri et al. . | |
| 3,900,321 | 8/1975 | Ferguson . | |
| 5,028,521 | 7/1991 | Grzeskowiak | 430/569 |
| 5,474,881 | 12/1995 | Slater et al. | 430/506 |
| 5,587,280 | 12/1996 | Ikeda et al. | 430/567 |

FOREIGN PATENT DOCUMENTS

| | | |
|---|---|---|
| 1 351 463 | 1/1974 | United Kingdom . |
| 1 351 464 | 1/1974 | United Kingdom . |

*Primary Examiner*—Thorl Chea

*Attorney, Agent, or Firm*—Gregory Evearitt; Arlene K. Musser

[57] ABSTRACT

The present invention describes a light-sensitive silver halide photographic material comprising a support and silver halide emulsion layer or layers, wherein at least one of said silver halide emulsion layers contains tabular silver halide grains having an average diameter to thickness ratio of at least 2:1 and at least one azodicarbonamide derivative.

20 Claims, No Drawings

LIGHT-SENSITIVE PHOTOGRAPHIC MATERIALS COMPRISING TABULAR SILVER HALIDE GRAINS AND AZODICARBONAMIDE DERIVATIVES

FIELD OF THE INVENTION

This invention relates to light-sensitive silver halide photographic materials and, more particularly, to light-sensitive silver halide photographic materials comprising tabular silver halide grains.

BACKGROUND OF THE INVENTION

Tabular silver halide grains are crystal possessing two major faces that are substantially parallel in which the average diameter of said faces is at least two times the distance separating the faces.

Silver halide photographic emulsions containing a high proportion of tabular grains have advantages of good developability, improved covering power and increased useful adsorption of sensitizing dye per weight of silver due to their high surface area-to-volume ratio. The use of such emulsions in photographic materials is disclosed in U.S. Pat. Nos. 4,425,425, 4,425,426, 4,433,048, 4,435,499, 4,439,520, and other related patents.

However, photographic materials containing tabular silver halide grains also have certain disadvantages. One of these is that they tend to easily fog under high temperature accelerated processing. Therefore, tabular silver halide grains are not always satisfactory for use in photographic emulsions required to have high sensitivity and low fog.

It is known to incorporate various additives, such as stabilizers and anti-foggants, in ordinary light-sensitive silver halide photographic materials to minimize the rise of fog resulting from development processing conditions. For example, nitrobenzimidazoles, mercaptothiazoles, benzotriazoles, nitrobenzotriazoles, mercaptotetrazoles, etc., are described as such additives in E. J. Birr, "Stabilization of Photographic Silver Halide Emulsions", Focal Press, and in U.S. Pat. Nos. 3,954,474, 3,982,974, etc. However, while these additives can depress an increase of fog in a light-sensitive silver halide photographic material containing tabular grains during high temperature processing to some extent, a significant decrease in sensitivity cannot be prevented.

For example, it is known to use light-sensitive silver halide photographic materials in high-temperature development processing using automatic developing machines. To enhance the physical strength of the photographic materials during the development at high temperature and in automatic developing machines and prevent them from becoming physically fragile, it is known to conduct the processing with an aldehyde hardener in the developing solution. However, a developing process with a developing solution containing an aldehyde, particularly an aliphatic dialdehyde, concurrently causes an increase of fog, particularly as the temperature of the developing solution increases. The fog can be depressed to some extent by using strong antifogging agents such as benzotriazoles and 1-phenyl-5-mercaptotetrazoles in the developing solutions (as described in L. F. Mason, Photographic Processing Chemistry, Focal Press). However, these antifogging agents, when used to develop light-sensitive silver halide photographic materials containing tabular silver halide grains, concurrently depress development and reduce photographic speed.

The use of azodicarbonamide fog inhibitors in silver halide emulsion is disclosed in U.S. Pat. No. 3,655,391 and in GB 1,351,463. Both these references discloses the use of azodicarbonamide fog inhibitors in conventional silver halide emulsions and the examples of U.S. Pat. No. 3,655,391 clearly show that a decrease of sensitivity is present together with the decrease of fog.

SUMMARY OF THE INVENTION

The present invention describes a light-sensitive silver halide photographic material comprising a support and silver halide emulsion layer or layers, wherein at least one of said silver halide emulsion layers contains tabular silver halide grains having an average diameter to thickness ratio of at least 2:1 and at least one azodicarbonamide derivative.

The light-sensitive material of this invention can be advantageously used in high temperature processing and shows an unexpected increase of speed together with a reduction of fog.

DETAILED DESCRIPTION OF THE INVENTION

The present invention describes a light-sensitive silver halide photographic material comprising a support and silver halide emulsion layer or layers, wherein at least one of said silver halide emulsion layers contains tabular silver halide grains having an average diameter to thickness ratio of at least 2:1 and at least one azodicarbonamide derivative.

According to the scope of the present invention, the term "azodicarbonamide derivative" means that at least one hydrogen of at least one nitrogen atom of the azodicarbonamide compound has been replaced by an organic group, such as, for example, an alkyl group, an aryl group, a heterocyclic group, and the like, or that at least one of the nitrogen atoms has been included in a heterocyclic ring.

In a preferred embodiment, the azodicarbonamide derivatives of the present invention can be represented by the following formula:

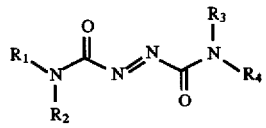

(I)

wherein $R_1$, $R_2$, $R_3$, and $R_4$ are, independently hydrogen atom, alkyl group (including cycloalkyl), aryl group, heterocyclic group, provided that at least one of $R_1$, $R_2$, $R_3$, and $R_4$ is different from hydrogen, or wherein at least one of $R_1$ and $R_2$, and $R_3$ and $R_4$, represents the atoms necessary to complete a heterocyclic group. In a preferred embodiment, at least one of $R_1$ and $R_2$, and at least one of $R_3$ and $R_4$ are different from hydrogen. The heterocyclic group formed by $R_1$ and $R_2$, and $R_3$ and $R_4$, is preferably a five or six membered heterocyclic group. Preferably, the heterocyclic group has at least one additional heteroatom, such as, nitrogen atom, oxygen atom, sulfur atom, and the like. Heterocyclic groups comprising at least one nitrogen atom and, preferably, other heteroatoms are, for example, pyrrole, pyrroline, pyrrolidine, imidazole, imidazoline, imidazolidine, pyrazole, pyrazoline, pyrazolidine, oxazoline, oxazolidine, isoxazoline, isoxazolidine, thiazoline, thiazolidine, isothiazoline, isothiazolidine, triazole, triazoline, triazolidine, piperidine, piperidazine, piperimidine, piperazine, morpholine, indole, indoline, indazole, indazoline, carbazole, and the like.

According to the scope of the present invention when the term "group" is used to describe a chemical compound or substituent, the described chemical material includes the basic group and that group with conventional substitution and/or ring condensation. Where the term "moiety" is used to describe a chemical compound or substituent only an unsubstituted chemical material is intended to be included.

The azodicarbonamide derivatives can be added to the silver halide tabular grain emulsion at any time from between the silver halide tabular emulsion preparation and the coating of said silver halide tabular emulsion on the support base. The azodicarbonamide derivatives can be conveniently added to the silver halide emulsion layer during coating of the silver halide emulsion on the support base. The azodicarbonamide derivatives are used in an amount of from 0.01 to 10 mmol per mole of silver halide, preferably from 0.05 to 5 mmol per mole of silver halide, more preferably from 0.1 to 1 mmol per mole of silver halide.

Preferred compounds of the azodicarbonamide derivatives according to the formula (I) above useful in the photographic material of the present invention are exemplified below, but the present invention is not limited thereby:

1. 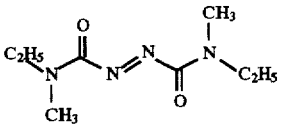

2. 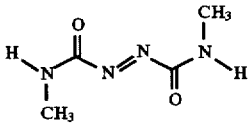

3. 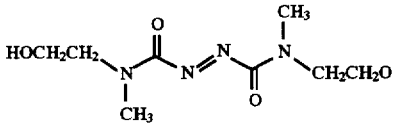

4. 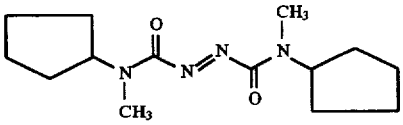

5. 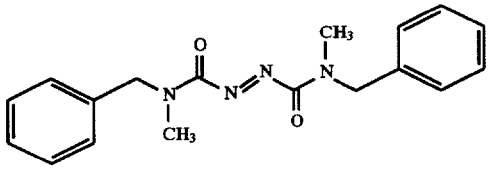

6. 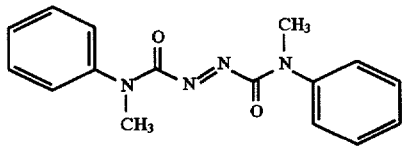

7. 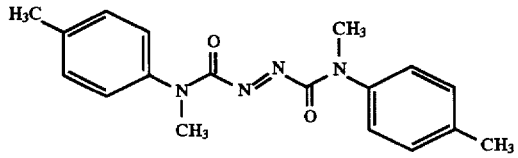

-continued

8. 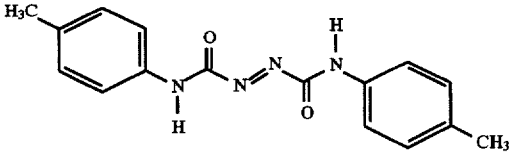

9. 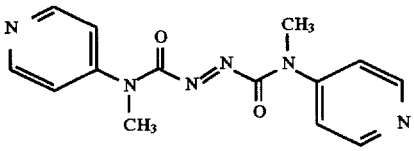

10. 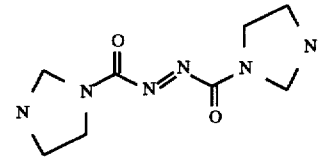

11. 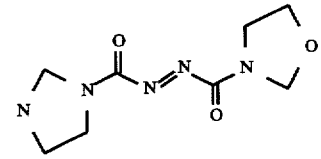

12. 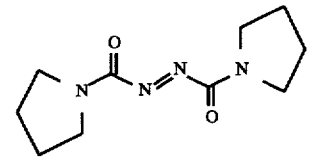

13. 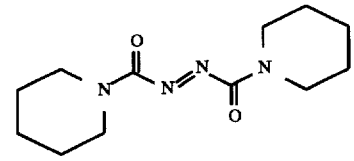

14. 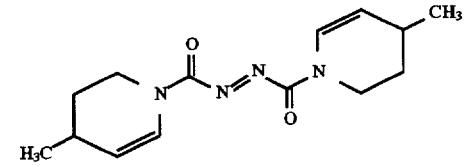

15. 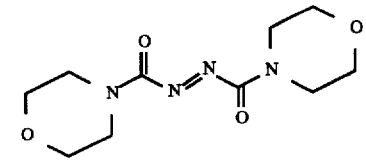

16. 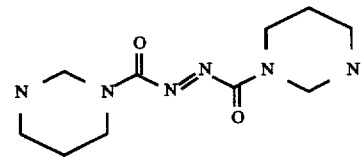

The photographic material of the present invention comprises at least one silver halide emulsion layer comprising tabular silver halide grains. Tabular silver halide grains have an average diameter to thickness ratio (often referred to in the art as aspect ratio) of at least 2:1, preferably 3:1 to 20:1, more preferably 4:1 to 14:1, and most preferably 5:1 to 8:1.

The tabular silver halide grains suitable for use in this invention have an average diameter of at least 0.3 μm. Average diameters of the tabular silver halide grains suitable for use in this invention range from about 0.3 μm to about 5 μm, preferably 0.5 μm to 3 μm, more preferably 0.8 μm to 1.5 μm. The tabular silver halide grains suitable for use in this invention have a thickness of less than 0.4 μm, preferably less than 0.3 μm and more preferably within 0.1 μm to 0.3 μm. The projected area of the tabular silver halide grains accounts for at least 50%, preferably at least 80% and more preferably at least 90% of the projected area of all the silver halide grains contained in the emulsion layer.

The tabular silver halide grain dimensions and characteristics described above can be readily ascertained by procedures well known to those skilled in the art. The term "diameter" is defined as the diameter of a circle having an area equal to the projected area of the grain. The term "thickness" means the distance between two substantially parallel main planes constituting the tabular silver halide grains. From the measure of diameter and thickness of each grain the diameter to thickness ratio of each grain can be calculated, and the diameter to thickness ratios of all tabular grains can be averaged to obtain their average diameter to thickness ratio. By this definition the average diameter to thickness ratio is the average of individual tabular grain diameter to thickness ratios. In practice, it is simpler to obtain an average diameter and an average thickness of the tabular grains and to calculate the average diameter to thickness ratio as the ratio of these two averages. Whatever the method used, the average diameter to thickness ratios obtained do not greatly differ.

In the present invention, commonly employed halogen compositions of the silver halide grains can be used. Typical silver halides include silver chloride, silver bromide, silver iodide, silver, silver, silver and the like. However, silver bromide and silver are preferred silver halide compositions for tabular silver halide grains with silver compositions containing from 0 to 10 mol % silver iodide, preferably from 0.2 to 5 mol % silver iodide, and more preferably from 0.5 to 1.5% mol silver iodide. The halogen composition of individual grains may be homogeneous or heterogeneous.

Silver halide emulsions containing tabular silver halide grains can be prepared by various processes known for the preparation of photographic materials.

Silver halide emulsions can be prepared using a single-jet method, a double-jet method, or a combination of these methods and can be ripened using, for instance, an ammonia method, a neutralization method, or an acid method. Features which may be adjusted to control grain growth include pH, pAg, temperature, shape and size of reaction vessel, and the reaction method (e.g., accelerated or constant flow rate precipitation, interrupted precipitation, ultrafiltration during precipitation, reverse mixing process and combinations of those). A silver halide solvent, such as ammonia, thioethers, thioureas, etc., may be used, if desired, for controlling grain size, form of the grains, particle size distribution of the grains, and the grain-growth rate. References can be found in Trivelli and Smith, *The Photographic Journal*, Vol. LXXIX, May 1939, pp. 330–338, T. H. James, *The Theory of The Photographic Process*, 4th Edition, Chapter 3, U.S. Pat. Nos. 2,222,264, 3,650,757, 3,917,485, 3,790,387, 3,716,276, 3,979,213, Research Disclosure, Dec. 1989, Item 308119 "Photographic Silver Halide Emulsions, Preparations, Addenda, Processing and Systems", and Research Disclosure, Sept. 1976, Item 14987.

Preparation of silver halide emulsions containing tabular silver halide grains is described, for example, in de Cugnac and Chateau, "Evolution of the Morphology of Silver Bromide Crystals During Physical Ripening", Science and Industries Photographiques, Vol. 33, No.2 (1962), pp.121–125, in Gutoff, "Nucleation and Growth Rates During the Precipitation of Silver Halide Photographic Emulsions", Photographic Science and Engineering, Vol. 14, No. 4 (1970), pp. 248–257, in Berry et al., "Effects of Environment on the Growth of Silver Bromide Microcrystals", Vol.5, No.6 (1961), pp. 332–336, in U.S. Pat. Nos. 4,063,951, 4,067,739, 4,184,878, 4,434,226, 4,414,310, 4,386,156, 4,414,306 and in EP Pat. Appln. No. 263,508.

The preparation process of a silver halide emulsion generally comprises a nucleation step, in which silver halide grain seeds are formed, followed by one or more growing steps, in which the grain seeds achieve their final dimension, and a washing step, in which all soluble salts are removed from the final emulsion. A ripening step is usually present between the nucleation and growing step and/or between the growing and the washing steps.

Into a conventional reaction vessel for silver halide precipitation equipped with a stirring apparatus is introduced a dispersing medium aqueous solution comprising a halide salt. The halide salt is usually a soluble alkali metal salt, e.g., KX, NaX, a soluble alkaline earth metal salt, e.g., $MgX_2$, $CaX_2$, or an ammonium salt, wherein X is any of bromide, chloride or iodide. Pure bromide is preferred, even if lower amount of iodide are usually employed. Iodide content in a silver emulsion usually ranges from 0.1 to 10 mole percent based on the total halide content of the emulsion.

The dispersing medium initially present in the reaction vessel can be chosen among those conventionally employed in the silver halide emulsions. Preferred dispersion media include hydrophilic colloids, such as proteins, protein derivatives, cellulose derivatives (e.g. cellulose esters), gelatin (e.g. acid or alkali treated gelatin), gelatin derivatives (e.g. acetylated gelatin, phthalated gelatin and the like), polysaccharides (e.g. dextran), gum arabic, casein and the like. It is also common to employ said hydrophilic colloids in combination with synthetic polymeric binders and peptizers such as acrylamide and methacrylamide polymers, polymers of alkyl and sulfoalkyl acrylates and methacrylates, polyvinyl alcohol and its derivatives, polyvinyl lactams, polyamides, polyamines, polyvinyl acetates, and the like.

The temperature of the reaction vessel content is preferably in the range of from 30° C. to 80° C., more preferably from 40° C. to 70° C. The pBr of the starting solution ranges from 0.3 to 2.0, preferably from 0.5 to 1.5.

The silver halide nuclei can be formed either by double jet addition of silver nitrate and bromide salt aqueous solutions or by single jet addition of a silver nitrate aqueous solution. During the nucleation step, the aqueous solutions can be either added at a steady rate or at an accelerated rate. An amount of silver nitrate ranging from 1% to 10% by weight of the total silver nitrate is usually added during the nucleation step. The term "total silver nitrate" means the amount of silver nitrate employed during the overall emulsion making process, that is, from the nucleation step to the final growing step.

At the end of the nucleation step, the addition of silver nitrate and bromide salt is usually stopped and the obtained silver halide nuclei can be ripened for period of time of from 30 seconds to 30 minutes. The ripening step can be performed in the presence of a silver halide solvent, e.g., thiourea, ammonia, thioether, thiosulfate or thiocyanate, which can be added either before or during the ripening step.

After that the silver halide seed grains are grown by double jet addition of a silver nitrate aqueous solution and a bromide salt aqueous solution. The growing step can also be stopped to allow a pBr correction by single jet addition of a silver nitrate or bromide salt aqueous solution. In this case, the growing step may be deemed to be split in two or more sub-growing steps. The pBr value is usually controlled in the range of from 1 to 3, preferably from 1.5 to 2.5. During the growing step, a soluble iodide salt can also be added together with the bromide salt. In this case the amount of the iodide present in the final emulsion ranges from 0.01 to 10% mol, preferably from 0.05 to 5% mol based on the total halide. An amount of silver nitrate ranging from 50% to 80% by weight of the total silver nitrate is usually added during the growing step(s).

At the end of the growing step(s), the tabular grains can be further ripened for a period of time of from 1 to 20 minutes by addition of a silver halide solvent in an amount of from 0.1 to 30 g per mole of silver halide. Useful ripening agents include silver halide solvents such as, for example, thiourea, ammonia, thioether, thiosulfate or thiocyanate.

In order to reach the proper final size, the tabular silver halide grain obtained at the end of the growing step are usually further grown by double jet addition of a silver nitrate aqueous solution and a bromide salt aqueous solution at steady or accelerated flow rate. An amount of silver nitrate ranging from 20% to 40% by weight of the total silver nitrate is usually added during this final growing step.

At the end of the tabular silver halide grain formation, water soluble salts are removed from the emulsion by procedures known in the art. Suitable cleaning arrangements are those wherein the dispersing medium and soluble salts dissolved therein can be removed from the silver halide emulsion on a continuous basis, such as, for example, a combination of dialysis or electrodialysis for the removal of soluble salts or a combination of osmosis or reverse osmosis for the removal of the dispersing medium.

In a particularly preferred embodiment, among the known techniques for removing the dispersing medium and soluble salts while retaining silver halide grains in the remaining dispersion, ultrafiltration is a particularly advantageous cleaning arrangement for the practice of this process. Typically, an ultrafiltration unit comprising membranes of inert, non-ionic polymers is used as a cleaning arrangement. Since silver halide grains are large in comparison with the dispersing medium and the soluble salts or ions, silver halide grains are retained by said membranes while the dispersing medium and the soluble salts dissolved therein are removed.

The action mechanism of preferred membranes is described in GB 1,307,331. The membranes used in the ultrafiltration comprise a very thin layer of extremely fine pore texture supported upon a thicker porous structure. Suitable membranes consist of polymers such as polyvinylacetate, polyvinylalcohol, polyvinylformate, polyvinylethers, polyamides, polyimides, polyvinyl chloride and polyvinylidene chloride, aromatic polymers, such as aromatic polyesters, polytetrafluoroethylene, regenerated cellulose, cellulose esters, such as cellulose acetate, or mixed cellulose esters. The membranes in question have anisotropic, semipermeable properties, show considerable mechanical, thermal and chemical stability and are photographically inert. The membranes are preferably permeable to molecules having molecular weights of up to about 300,000 and, more especially, of up to about 50,000.

Prior to use, the tabular silver halide grain emulsion prepared according to the method of the present invention is generally fully dispersed and bulked up with gelatin or other dispersion of peptizer and subjected to any of the known methods for achieving optimum sensitivity.

Chemical sensitization is performed by adding chemical sensitizers and other additional compounds to the silver halide emulsion, followed by the so-called chemical ripening at high temperature for a predetermined period of time. Chemical sensitization can be performed by various chemical sensitizers such as gold, sulfur, reducing agents, platinum, palladium, selenium, sulfur plus gold, and the like. The tabular silver halide grains for use in the present invention, after grain formation and desalting, are chemically sensitized by at least one gold sensitizer and at least one thiosulfonate sensitizer. During chemical sensitization other compounds can be added to improve the photographic performances of the resulting silver halide emulsion, such as, for example, antifoggants, stabilizers, optical sensitizers, supersensitizers, and the like.

Gold sensitization is performed by adding a gold sensitizer to the emulsion and stirring the emulsion at high temperature of preferably 40° C. or more for a predetermined period of time. As a gold sensitizer, any gold compound which has an oxidation number of +1 or +3 and is normally used as gold sensitizer can be used. Preferred examples of gold sensitizers are chloroauric acid, the salts thereof and gold complexes, such as those described in U.S. Pat. No. 2,399,083. It is also useful to increase the gold sensitization by using a thiocyanate together with the gold sensitizer, as described, for example, in T. H. James, The Theory of the Photographic Process, 4th edition, page 155, published by MacMillan Co., 1977. Specific examples of gold sensitizers include chloroauric acid, potassium chloroaurate, auric trichloride, sodium aurithiosulfate, potassium aurithiocyanate, potassium iodoaurate, tetracyanoauric acid, 2-aurosulfobenzothiazole methochloride and ammonium aurothiocyanate.

Thiosulfonate sensitization is performed by adding a thiosulfonate sensitizer to the tabular silver halide emulsion and stirring the emulsion at a high temperature of 40° C. or more for a predetermined period of time.

The amounts of the gold sensitizer and the thiosulfonate sensitizer change in accordance with the various conditions, such as activity of the gold and thiosulfonate sensitizer, type and size of tabular silver halide grains, temperature, pH and time of chemical ripening. These amounts, however, are preferably from 1 to 20 mg of gold sensitizer per mol of silver, and from 1 to 100 mg of thiosulfonate sensitizer per mol of silver. The temperature of chemical ripening is preferably 45° C. or more, and more preferably 50° C. to 80° C. The pAg and pH may take arbitrary values.

During chemical sensitization, addition times and order of gold sensitizer and thiosulfonate sensitizer are not particularly limited. For example, gold and thiosulfonate sensitizers can be added at the initial stage of chemical sensitization or at a later stage either simultaneously or at different times. Usually, gold and thiosulfonate sensitizers are added to the tabular silver halide emulsion by their solutions in water, in a water-miscible organic solvent, such as methanol, ethanol and acetone, or as a mixture thereof.

The tabular silver halide emulsions of the present invention are preferably spectrally sensitized. It is specifically contemplated to employ in the present invention, in combination with the tabular silver halide emulsions, spectral sensitizing dyes having absorption maxima in the blue, minus blue (i.e., green and red) and infrared portions of the electromagnetic spectrum. Spectral sensitizing dyes for use in the present invention include polymethine dyes, such as cyanine and complex cyanine dyes, merocyanine and complex merocyanine dyes, as well as other dyes, such as oxonols, hemioxonols, styryls, merostyryls and streptocyanines as described by F. M. Hamer, The Cyanine and Related Compounds, Interscience Publishers, 1964.

The cyanine dyes include, joined by a methine linkage, two basic heterocyclic nuclei, such as pyrrolidine, oxazoline, thiazoline, pyrrole, oxazole, thiazole, selenazole, tetrazole and pyridine and nuclei obtained by fusing an alicyclic hydrocarbon ring or an aromatic hydrocarbon ring to each of the above nuclei, such as indolenine, benzindolenine, indole, benzoxazole, naphthoxazole, benzothiazole, naphthothiazole, benzoselenazole, benzimidazole and quinoline. These nuclei can have substituents groups.

The merocyanine dyes include, joined by a methine linkage, a basic heterocyclic nucleus of the type described above and an acid nucleus, such as a 5- or 6-membered heterocyclic nucleus derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3-dione, cyclohexane-1-3-dione, and isoquinolin-4-one.

The methine spectral sensitizing dyes for use in this invention are generally known in the art. Particular reference can be made to U.S. Pat. Nos. 2,503,776, 2,912,329, 3,148,187, 3,397,060, 3,573,916 and 3,822,136 and FR Pat. No. 1,118,778. Also their use in photographic emulsions is very known wherein they are used in optimum concentrations corresponding to desired values of sensitivity to fog ratios. Optimum or near optimum concentrations of spectral sensitizing dyes in the emulsions of the present invention generally go from 10 to 500 mg per mol of silver, preferably from 50 to 200, more preferably from 50 to 100.

Spectral sensitizing dyes can be used in combinations which result in supersensitization, i.e., spectral sensitization which is greater in a spectral region than that from any concentration of one dye alone or which would result from an additive effect of the dyes. Supersensitization can be obtained with selected combinations of spectral sensitizing dyes and other addenda, such as stabilizers and antifoggants, development accelerators and inhibitors, optical brighteners, surfactants and antistatic agents, as described by Gilman, Photographic Science and Engineering, 18, pp. 418–430, 1974 and in U.S. Pat. Nos. 2,933,390, 3,635,721, 3,743,510, 3,615,613, 3,615,641, 3,617,295 and 3,635,721.

Preferably, spectral sensitizing dyes are used in supersensitizing combination with polymeric compounds containing an aminoallylidenemalononitrile (>N—CH=CH—CH=$(CN)_2$) moiety, as those described in U.S. Pat. No. 4,307,183. Said polymeric compounds are preferably obtained upon copolymerization of an allyl monomer which has an ethylenically condensed aminoallylidenemalononitrile moiety (such as diallylaminoallylidenemalononitile monomer therein with an ethylenically unsaturated monomer, said monomer being preferably a water-soluble monomer; said copolymerization being preferably a solution polymerization said polymeric compound being preferably a water-soluble polymer; said monomer more preferably being an acrylic or methacrylic monomer, most preferably being acrylamide or acrylic acid.

Methods of preparation of said polymeric compounds are described in the above mentioned U.S. Pat. No. 4,307,183. The optimum concentrations of said polymeric compounds generally go from 10 to 1,000 mg per mol of silver, preferably from 50 to 500, more preferably from 150 to 350, the weight ratio of the polymeric compound to the spectral sensitizing dye normally being of 10/1 to 1/10, preferably 5/1 to 1/5, more preferably 2.5/1 to 1/1 (such a ratio of course depending upon the aminoallylidene-malononitrile moiety content of the polymeric compound: the higher such content, the lower such ratio).

Spectral sensitization can be performed at any stage of silver halide preparation. It can be performed subsequent to the completion of chemical sensitization or concurrently with chemical sensitization, or can precede chemical sensitization, or even can commence prior to the completion of silver halide precipitation. In the preferred form, spectral sensitizing dyes can be incorporated in the tabular grain silver halide emulsions prior to chemical sensitization.

A light-sensitive silver halide photographic material can be prepared by coating the above described silver halide emulsion on a photographic support. There is no limitation with respect to the support. Examples of materials suitable for the preparation of the support include glass, paper, polyethylene-coated paper, metals, cellulose nitrate, cellulose acetate, polystyrene, polyesters such as polyethylene terephthalate, polyethylene, polypropylene and other well known supports.

Said light-sensitive silver halide photographic material specifically is applicable to light-sensitive photographic color materials such as color negative films, color reversal films, color papers, etc., as well as black-and-white light-sensitive photographic materials such as X-ray light-sensitive materials, lithographic light-sensitive materials, black-and-white photographic printing papers, black-and-white negative films, etc.

Preferred light-sensitive silver halide photographic materials are X-ray light-sensitive materials comprising the above described silver halide emulsion coated on one surface, preferably on both surfaces of a support, preferably a polyethylene terephthalate support. Preferably, the silver halide emulsion is coated on the support at a total silver coverage comprised in the range of 3 to 6 grams per square meter. Usually, the X-ray light-sensitive materials are associated with intensifying screens so as to be exposed to radiation emitted by said screens. The screens are made of relatively thick phosphor layers which transform the X-rays into light radiation (e.g., visible light). The screens absorb a portion of X-rays much larger than the light-sensitive material and are used to reduce the X-ray dose necessary to obtain a useful image. According to their chemical composition, the phosphors can emit radiation in the blue, green or red region of the visible spectrum and the silver halide emulsions are sensitized to the wavelength region of the light emitted by the screens. Sensitization is performed by using spectral sensitizing dyes adsorbed on the surface of the silver halide grains as known in the art.

The exposed light-sensitive materials of this invention can be processed by any of the conventional processing techniques. The processing can be a black-and-white photographic processing for forming a silver image or a color photographic processing for forming a dye image depending upon the purpose. Such processing techniques are illustrated for example in Research Disclosure, 17643, December 1978. Roller transport processing in an automatic processor is particularly preferred, as illustrated in U.S. Pat. Nos. 3,025,779, 3,515,556, 3,545,971 and 3,647,459 and in GB Pat. No. 1,269,268. Hardening development can be undertaken, as illustrated in U.S. Pat. No. 3,232,761.

The silver halide emulsion layer containing the tabular silver halide grain emulsion obtained with the method of this invention can contain other constituents generally used in photographic products, such as binders, hardeners, surfactants, speed-increasing agents, stabilizers, plasticizers, optical sensitizers, dyes, ultraviolet absorbers, etc., and reference to such constituents can be found, for example, in Research Disclosure, Vol. 176 (December 1978), pp. 22–28. Ordinary silver halide grains may be incorporated in the emulsion layer containing the tabular silver halide grains as well as in other silver halide emulsion layers of the light-sensitive silver halide photographic material of this invention. Such grains can be prepared by processes well known in the photographic art.

The present invention is now illustrated by reference to the following examples, which are not intended to limit the scope of the invention.

EXAMPLE 1

Synthesis of N,N'-dimorpholino-azodicarbonamide 87 g of morpholine dissolved in 150 ml of toluene were added dropwise to a 40% w/w toluene solution of 218 g of diethyl azodicarboxylate at about 0° C. An orange precipitate soon separated and the reaction was completed in about 20 minutes. The product was suction filtered, rinsed with diethyl ether, dried under vacuum at room temperature, and purified by crystallization from ethanol. Melting point was measured at 141°–143° C.

EXAMPLE 2

Synthesis of N,N'-di-p-tholyl-azodicarbonamide 17.8 g of bromosuccinimide dissolved in 200 ml of pyridine were added dropwise to 14.9 g of N,N'-di-p-tolyl-hydrazodicarbonamide suspended in 300 ml of pyridine at about 70° C. The resulting solution was poured into ice water and the orange-red precipitate which formed was suction filtered, rinsed with diethyl ether, dried under vacuum at room temperature, and purified by crystallization from hot ethyl acetate. The resulting compound decomposed at 172°–175° C.

EXAMPLE 3

Synthesis of N,N'-di-methyl-azodicarbonamide 17.8 g of bromosuccinimide dissolved in 200 ml of pyridine were added dropwise to 14.9 g of N,N'-dimethyl-hydrazodicarbonamide suspended in 300 ml of pyridine at about 70° C. The resulting solution was poured into ice water and the precipitate which formed was suction filtered, rinsed with diethyl ether, dried under vacuum at room temperature, and purified by crystallization. The resulting compound decomposed at 172°–175° C.

EXAMPLE 4

A tabular grain silver emulsion having average grain size of 1.35 mm and average grain thickness 0.19 μm (prepared in the presence of a deionized gelatin having a viscosity at 60° C. in water at 6.67% w/w of 4.6 mPas, a conductibility at 40° C. in water at 6.67% w/w of less than 150 μS/cm and less than 50 ppm of $Ca^{++}$) was optically sensitized to green light with a cyanine dye. The emulsion was chemically sensitized with 20 mg/Ag mole of benzothiazoleiodoethylate, 6 mg/Ag mole of potassium tetrachloroaurate, 14.5 mg/Ag mole of sodium p-toluenethiosulfonate, and 5.2 mg/Ag mole of potassium chloropalladate. At the end of the chemical ripening the emulsion, was also added with 200 mg/Ag mole of KI and 1.373 g/Ag mole of 5-methyl-7-hydroxytriazaindolizine stabilizer. The resulting emulsion was divided into four portions (A to D), and, before coating, each portion was added with 3.34 g/Ag mole of 1,3-bis-vinylsulfonyl-2-propanol hardener and the compounds according to the following Table 1.

TABLE 1

| Emulsion | Compound | Amount (g/mole Ag) | Amount (mmol/mole Ag |
|---|---|---|---|
| A Comparison | NONE | / | / |
| B Comparison | 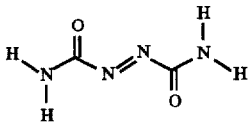 | 0.11 | 0.86 |
| C Invention | 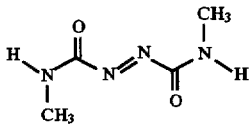 | 0.11 | 0.69 |
| D Invention | 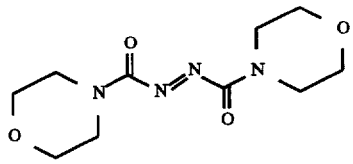 | 0.11 | 0.37 |

Each emulsion was coated on each side of a blue polyester film support at a silver coverage of 2.1 g/m$^2$ per side and gelatin coverage of 1.6 g/m$^2$ per side, so obtaining films A to D, respectively. A non-deionized gelatin protective top-coat containing 1.1 g/m$^2$ of gelatin per side was applied on each coating. The films A to D in the form of sheets were exposed to white light through a Wratten™ 98 and Wratten™ 99 filter for Dmin evaluation and to X-Ray at 74 KV using a 3M Trimatic™ T8 intensifying screen for speed evaluation. The exposed film were then processed in a 3M Trimatic™ XP515 automatic processor, by developing for 27 seconds at 35° C. with a hardener free developing solution, then fixing for 27 seconds at 30° C. with a hardener free fixing solution, and washing with water for 22 seconds at 35° C. and drying for 22 seconds at 35° C. The ready-to-use developing and fixing bath compositions used in processing the above mentioned films are described in the following tables 2 and 3.

TABLE 2

| DEVELOPER | | |
|---|---|---|
| Water | g | 700 |
| $Na_2S_2O_5$ | g | 40 |
| KOH 35% (w/w) | g | 107 |
| $K_2CO_3$ | g | 13.25 |
| $CH_3COOH$ | g | 7.5 |
| Ethyleneglycol | g | 10 |
| Diethyleneglycol | g | 5 |
| EDTA.4Na | g | 1.5 |
| BUDEX ™ 5103.2Na 40% (w/w) | g | 7.5 |
| Boric acid | g | 1.7 |
| 5-methyl-benzotriazole | g | 0.08 |
| 5-nitro-indazole | g | 0.107 |
| Hydroquinone | g | 20 |
| Phenidone | g | 1.45 |
| Sodium bromide | g | 5 |
| Water to make | l | 1 |
| pH at 20° C. | | 10.35 |

TABLE 3

| FIXER | | |
|---|---|---|
| $(NH_4)_2S_2O_3$ 60% (w/w) | g | 242 |
| $Na_2SO_3$ | g | 8.12 |
| $NH_4OH$ 25% (w/w) | g | 15 |
| $CH_3COOH$ | g | 20 |
| KI | g | 0.05 |
| Water to make | l | 1 |
| pH at 20° C. | | 5.0/5.2 |

Budex™ 5103 is the trade name of a morpholinomethane diphosphonic acid sold by Budenheim AG, having the following formula:

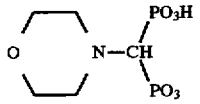

The sensitometric results are summarized in the following Table 4. Two different aging conditions were considered.

TABLE 4

| | 3 Days 38° C. | | 5 Days 50° C. | |
|---|---|---|---|---|
| Film | Dmin | Speed | Dmin | Speed |
| A (c) | 0.200 | 2.08 | / | / |
| B (c) | 0.200 | 2.17 | 0.220 | 2.19 |
| C (i) | 0.180 | 2.15 | 0.200 | 2.14 |
| D (i) | 0.190 | 2.14 | / | / |

(c) = comparison; (i) = invention

Film C and D of the present invention show the surprising result of having a remarkable increase in speed together with a strong reduction of Dmin.

We claim:

1. A light-sensitive silver halide photographic material comprising a support and silver halide emulsion layer or layers, wherein at least one of said silver halide emulsion layers contains tabular silver halide grains having an average diameter to thickness ratio of at least 2:1 and at least one azodicarbonamide derivative comprising an azodicarbonamide compound wherein at least one hydrogen attached to at least one nitrogen atom of said azodicarbonamide compound is replaced by an organic group, or at least one nitrogen atom of said azodicarbonamide compound is included in a heterocyclic ring.

2. The light-sensitive silver halide photographic material according to claim 1, wherein said azodicarbonamide derivative is represented by the following formula:

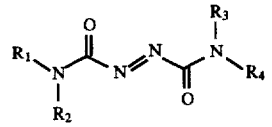

wherein $R_1$, $R_2$, $R_3$, and $R_4$ are, independently, hydrogen atom, alkyl group, aryl group, heterocyclic group, provided that at least one of $R_1$, $R_2$, $R_3$, and $R_4$ is different from hydrogen.

3. The light-sensitive silver halide photographic material according to claim 2, wherein at least one of $R_1$ and $R_2$, and at least one of $R_3$ and $R_4$ are not hydrogen.

4. The light-sensitive silver halide photographic material according to claim 2, wherein at least one of $R_1$ and $R_2$, and at least one of $R_3$ and $R_4$ are selected from the group consisting of alkyl group, cycloalkyl group, aryl group, and heterocyclic group.

5. The light-sensitive silver halide photographic material according to claim 1, wherein said azodicarbonamide derivative is represented by the following formula:

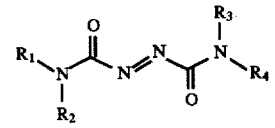

wherein at least one of $R_1$ and $R_2$, and $R_3$ and $R_4$, represents the atoms necessary to complete a heterocyclic group.

6. The light-sensitive silver halide photographic material according to claim 5, wherein said heterocyclic group is selected in the group of five and six membered heterocyclic groups.

7. The light-sensitive silver halide photographic material according to claim 5, wherein said heterocyclic group comprises at least one additional heteroatom.

8. The light-sensitive silver halide photographic material according to claim 5, wherein said additional heteroatom is selected from the group consisting of nitrogen atom, oxygen atom, and sulfur atom.

9. The light-sensitive silver halide photographic material according to claim 1, wherein said azodicarbonamide derivative is added in an amount of from 0.01 to 10 mmol per mole of silver halide.

10. The light-sensitive silver halide photographic material according to claim 1, wherein said azodicarbonamide derivative is added in an amount of from 0.05 to 5 mmol per mole of silver halide.

11. The light-sensitive silver halide photographic material according to claim 1, wherein said azodicarbonamide derivative is added in an amount of from 0.1 to 1 mmol per mole of silver halide.

12. The light-sensitive silver halide photographic material according to claim 1, wherein said tabular silver halide grains have an average diameter of at least 0.3 μm.

13. The light-sensitive silver halide photographic material according to claim 1, wherein the projected area of said tabular silver halide grains having a thickness lower than 0.4 μm accounts for at least 50% of the projected area of all the silver halide grains contained in said emulsion layer.

14. The light-sensitive silver halide photographic material according to claim 1, wherein said tabular silver halide grains have an average diameter from 0.3 μm to 5 μm and an average thickness less than 0.3 μm.

15. The light-sensitive silver halide photographic material according to claim 1, wherein said tabular silver halide grains have an average diameter from 0.5 μm to 3 μm and an average thickness from 0.1 μm to 0.3 μm.

16. The light-sensitive silver halide photographic material according to claim 1, wherein said tabular silver halide grains have an average diameter from 0.8 μm to 1.5 μm and an average thickness from 0.1 μm to 0.3 μm.

17. The light-sensitive silver halide photographic material of claim 1, wherein said average diameter to thickness ratio is 3:1 to 20:1.

18. The light-sensitive silver halide photographic material of claim 1, wherein said average diameter to thickness ratio is 4:1 to 14:1.

19. The light-sensitive silver halide photographic material of claim 1, wherein said average diameter to thickness ratio is 5:1 to 8:1.

20. A light-sensitive silver halide photographic material comprising a support and silver halide emulsion layer or layers, wherein at least one of said silver halide emulsion layers contains tabular silver halide grains having an average diameter to thickness ratio of 5:1 to 8:1 and at least one azodicarbonamide derivative represented by the following formula:

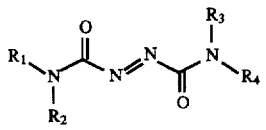

wherein $R_1$, $R_2$, $R_3$, and $R_4$ are, independently, selected from the group consisting of a hydrogen atom, an alkyl group, an aryl group, and a heterocyclic group, provided that at least one of $R_1$, $R_2$, $R_3$ and $R_4$ is different from hydrogen.

* * * * *